US007435190B2

(12) United States Patent
Sugimoto

(10) Patent No.: US 7,435,190 B2
(45) Date of Patent: Oct. 14, 2008

(54) GOLF CLUB HEAD

(75) Inventor: Yasushi Sugimoto, Kobe (JP)

(73) Assignee: SRI Sports Limited, Kobe (JP)

( * ) Notice: Subject to any disclaimer, the term of this patent is extended or adjusted under 35 U.S.C. 154(b) by 260 days.

(21) Appl. No.: 11/143,500

(22) Filed: Jun. 3, 2005

(65) Prior Publication Data

US 2005/0272527 A1 Dec. 8, 2005

(30) Foreign Application Priority Data

Jun. 3, 2004 (JP) ..... 2004-166122

(51) Int. Cl.
*A63B 53/04* (2006.01)

(52) U.S. Cl. ..... 473/345; 473/349

(58) Field of Classification Search ..... 473/324–350
See application file for complete search history.

(56) References Cited

U.S. PATENT DOCUMENTS 4,535,990 A * 8/1985 Yamada ..... 473/346
4,778,185 A * 10/1988 Kurokawa ..... 473/332
4,874,171 A * 10/1989 Ezaki et al. ..... 473/290
5,624,331 A * 4/1997 Lo et al. ..... 473/345
5,997,415 A * 12/1999 Wood ..... 473/346
6,929,565 B2 * 8/2005 Nakahara et al. ..... 473/345
6,945,876 B2 * 9/2005 Nakahara et al. ..... 473/329
7,037,214 B2 * 5/2006 Nakahara et al. ..... 473/345
7,214,142 B2 * 5/2007 Meyer et al. ..... 473/332
7,261,646 B2 * 8/2007 De Shiell et al. ..... 473/345
2001/0055995 A1 * 12/2001 Cackett et al. ..... 473/342
2004/0005936 A1 * 1/2004 Imamoto et al. ..... 473/344
2004/0192468 A1 * 9/2004 Onoda et al. ..... 473/345
2005/0159243 A1 * 7/2005 Chuang ..... 473/345
2006/0052181 A1 * 3/2006 Serrano et al. ..... 473/345

FOREIGN PATENT DOCUMENTS

JP 2001-340499 A 12/2001

* cited by examiner

*Primary Examiner*—Sebastiano Passaniti
(74) *Attorney, Agent, or Firm*—Birch, Stewart, Kolasch & Birch, LLP

(57) ABSTRACT

A hollow golf club head comprises a main body made of at least one kind of metal material, said main body provided with an opening having a surface area projected onto the head surface in the range of from 15% to 70% of the entire surface area of the head, and a cover member attached to said main body so as to cover said opening, said cover member made of a fiber reinforced resin having a resin content in the range of from 25% to 60%.

19 Claims, 9 Drawing Sheets

GOLF CLUB HEAD

BACKGROUND OF THE INVENTION

The present invention relates to a golf club head comprising a main body made of at least one kind of metal material and a cover member made of a fiber reinforced resin.

In recent years, hollow golf club heads comprising a metallic main body and a cover member made of fiber reinforced resin have been proposed. These heads can save the weight thereof on the basis of the small specific gravity of the resin. Further, the saved weight can be allocated, for example, in the sole portion or the like, and can improve degree of freedom in the weight allocation design or the like.

However, the heads mentioned above have a problem that a joint portion between the main body and the cover member tends to be peeled off.

Further, the head was expected to improve a feeling transmitted to hands of a player at the time of hitting a ball (hereinafter, refer to as a "ball hitting feeling"), however, it turned out that the ball hitting feeling is the same as a conventional metal head contrary to the expectation.

SUMMARY OF THE INVENTION

A main object of the present invention is to provide a golf club head which can improve a bonding strength between a fiber reinforced resin and a metal material, and can obtain a good ball hitting feeling. According to one aspect of the present invention, a hollow golf club head comprises a main body made of at least one kind of metal material having at least one opening, and a cover member made of a fiber reinforced resin attached to the main body so as to cover the opening, the fiber reinforced resin having a resin content in the range of from 25% to 60%, and the opening having an area projected on a head surface in the range of from 15% to 70% of the head surface.

DESCRIPTION OF THE PREFERRED EMBODIMENTS

Figure 1:
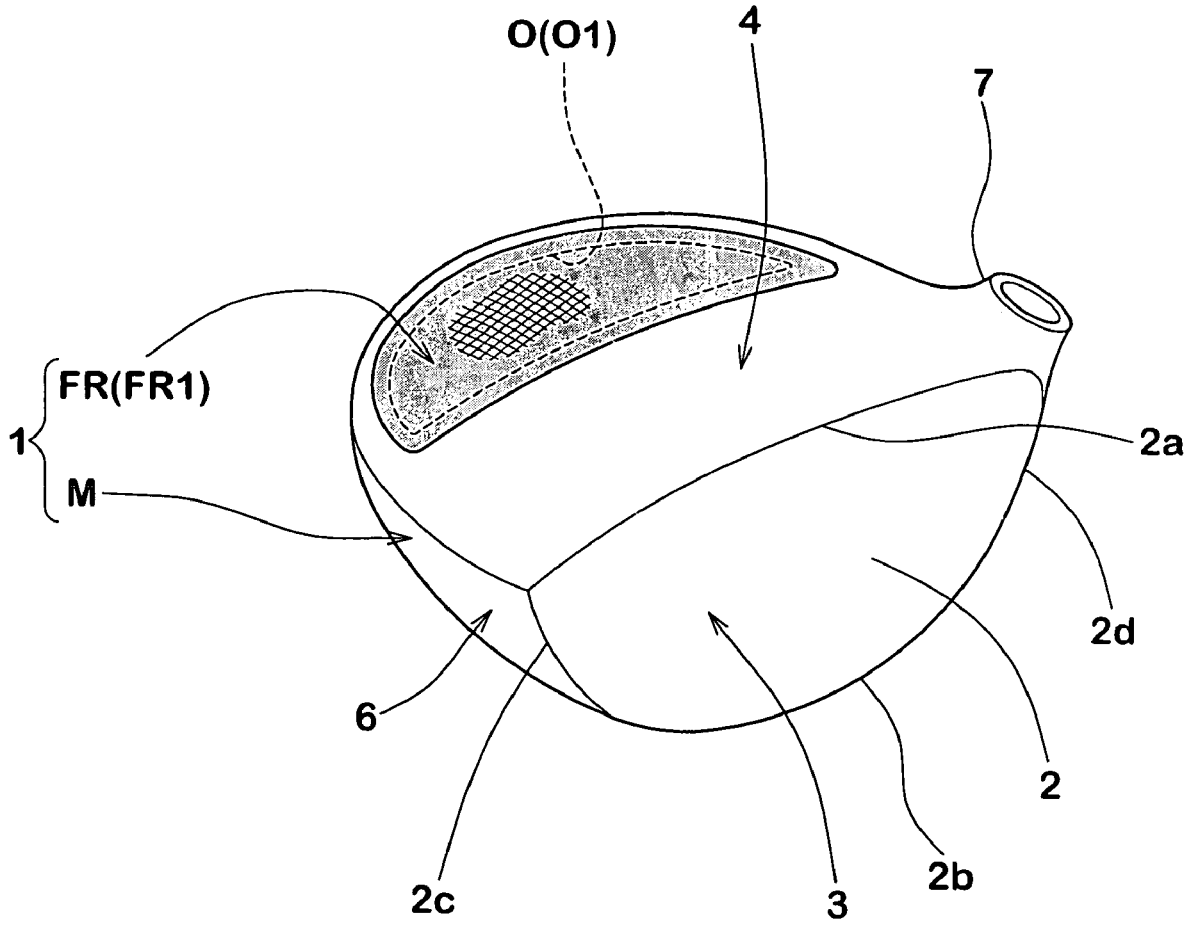
FIG. 1 is a perspective view of a wood-type gold club head according to the present invention.

Embodiments of the present invention will now be described in detail in conjunction with the accompanying drawings.

FIGS. 1 to 5 illustrate a standard condition in which a golf club head 1 according to the present embodiment is grounded on a horizontal surface HP at a prescribed lie angle and loft angle (real loft). In the drawings, the club head 1 according to the present invention is a hollow wood-type club head such as #1 driver and fairway wood having a cavity i therein.

The club head 1 comprises: a face portion 3 whose front face defines a club face 2 for striking a ball; a crown portion 4 intersecting the club face 2 at the upper edge 2*a* thereof; a sole portion 5 intersecting the club face 2 at the lower edge 2*b* thereof; a side portion 6 between the crown portion 4 and the sole portion 5 which extends from a toe-side edge 2*c* to a heel-side edge 2*d* of the club face 2 through the back face of the club head; and a neck portion 7 to be attached to an end of a club shaft (not shown).

The head 1 according to the present embodiment has a volume preferably equal to or more than 300 $cm^3$, more preferably equal to or more than 400 $cm^3$, and further preferably equal to or more than 420 $cm^3$. Therefore, it is possible to increase a comfort level when ready to hit the ball, a sweet spot area and a moment of inertia. In this case, an upper limit of the head volume is not particularly limited, however, it is desirable that it is, for example, equal to or less than 500 $cm^3$, and on the basis of a rule regulation of R&A and USGA, it is preferable to restrict to be equal to or less than 470 $cm^3$.

Figure 6:
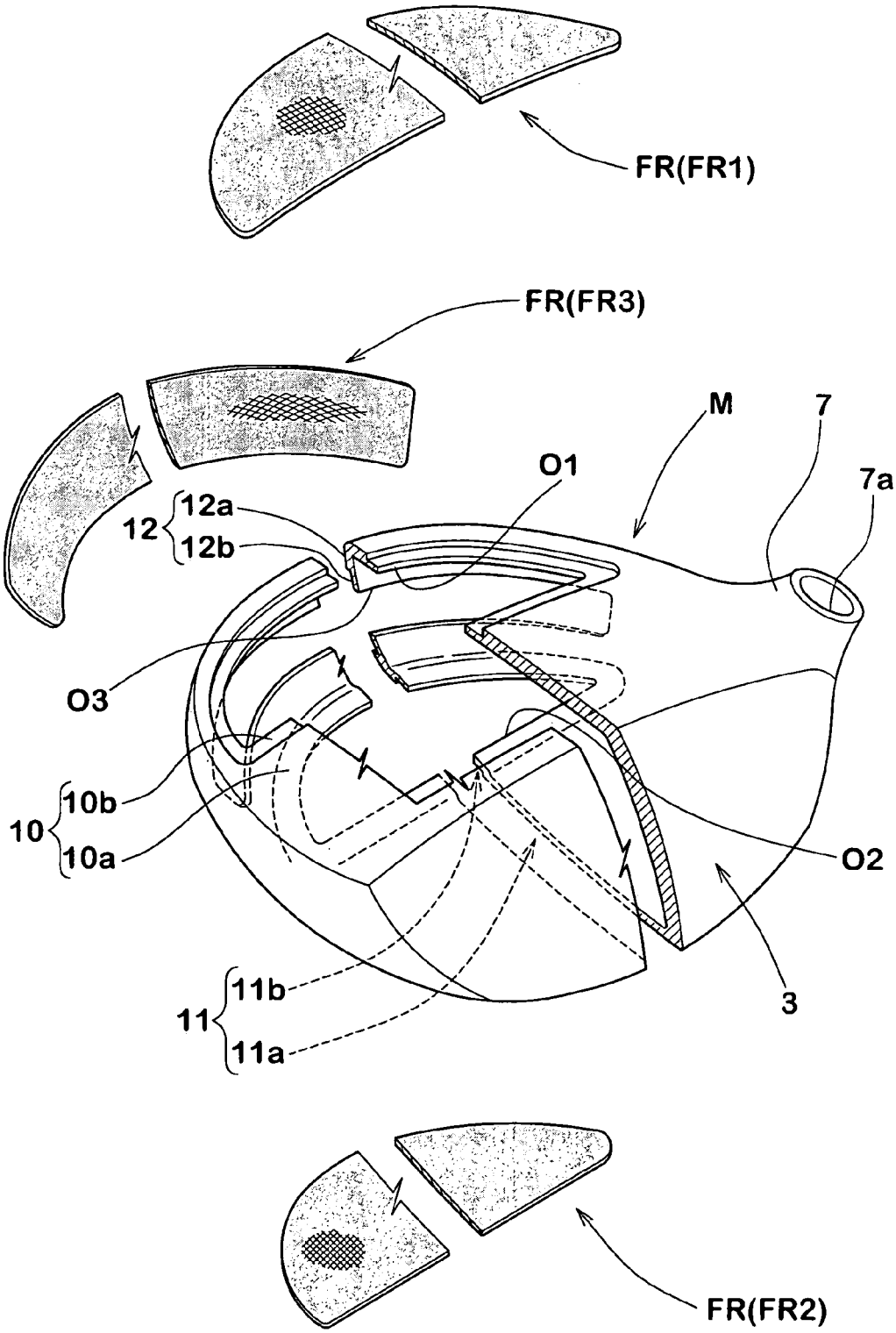
FIG. 6 is an exploded perspective view showing the head.

As illustrated in FIG. 6, the club head 1 according to the present embodiment comprises a main body M made of at least one kind of metal material, and at least one cover member FR made of fiber reinforcing resin and attached to the main body M.

The metal material forming the main body M is not particularly limited, however, can employ, for example, a stainless steel, a maraging steel, a titanium, a titanium alloy, an aluminum alloy, a magnesium alloy, an amorphous alloy or the like. Especially, a titanium alloy having a large specific strength is desirable. In this case, the main body M can be formed by using two or more kinds of metal materials. In this embodiment, the titanium alloy, Ti-6Al-4V, having a specific gravity in the range of from 4.4 to 4.5 is used.

The main body M comprises at least one opening. In this embodiment, a plurality of openings, more specifically three openings O1, O2 and O3, are provided on the main body M. Here, a shaft insert hole 7*a* provided with the neck portion 7 is not included in a number of the openings. These openings O1, O2 and O3 make it possible to reduce an amount of metal material in the main body M. Therefore, the club head 1 according to the present embodiment can produce a light head and/or improve degree of freedom in a weight allocation design or the like. Further, by providing two or more openings O, each opening area can be small and the strength reduction of the main body M can be prevented without reduction of a total opening area. From this viewpoint, the number of openings is preferably not less than two, more preferably not less than three. On the other hand, in an viewpoint of productivity of the main body M, the number of the openings is preferably not more than five and further preferably not more than four.

The main body M comprises: the face portion 3; a crown main wall 10 forming part of the crown portion 4 and having an upper opening O1; a sole main wall 11 forming part of the sole portion 5 and having a lower opening O2; a side main wall 12 forming part of the side portion 6 and having a middle opening O3; and the neck portion 7 since the main body M includes the side main wall 12, much weight is distributed by a circumference of the club head 1 and a moment of inertia thereof becomes large.

The main body M according to present embodiment is integrally formed in each of the portions by casting such main body M makes it possible to get an exact size about the lie and loft angles. Further, according to another embodiment, the main body M can be formed by forming two or more parts according to a working methods such as forging, casting, pressing and/or rolling and thereafter integrally bonding them according to welding or the like.

The crown main wall 10 includes a crown body portion 10*a* forming an outer surface of the crown portion 4 and a crown receiving portion 10*b* around the upper opening O1 provided on the back face side in the crown portion 4.

The crown receiving portion 10*b* has a stepped face for contacting and supporting the inner surface of the peripheral portion of an upper cover member FR1 to be attached thereto.

When hitting the ball, a comparatively large impact force is generated in the face portion 3. Accordingly, improvement of durability can be intended by arranging the upper opening O1 as far as possible from the club face 2.

Figure 5:
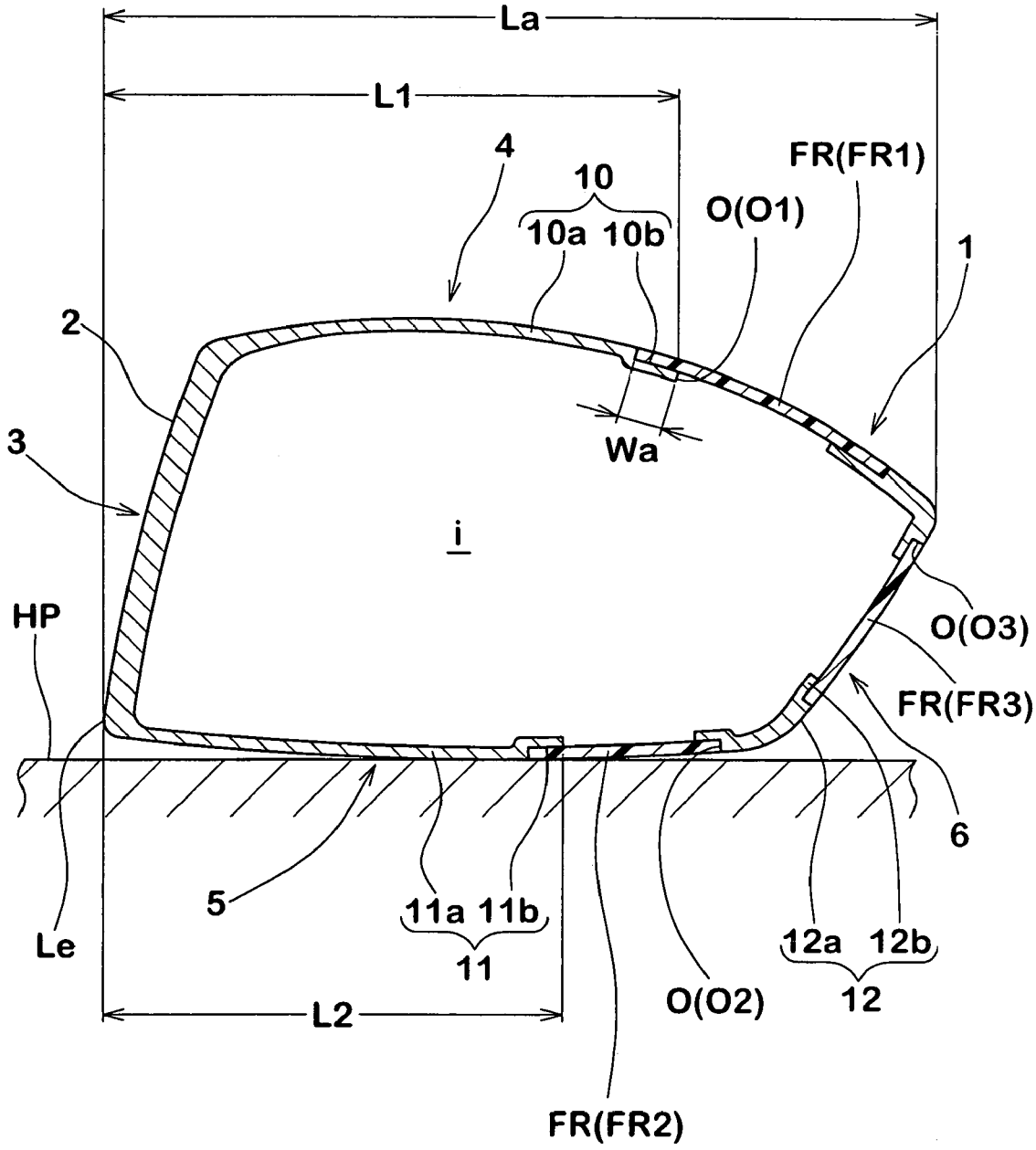
FIG. 5 is a cross sectional view taken on line A-A in FIG. 2.

Although not particularly limited, as illustrated in FIG. 5, it is desirable that the ratio (L1/La) between a head length La corresponding to a maximum length in a front-back direction from a leading edge Le (a position closest to the club face 2 in the standard condition) of the club head 1 to a head aftermost position, and a shortest distance L1 in the front-back direction from the leading edge Le to the upper opening O1 is preferably not less than 0.15, more preferably not less than 0.20, and further preferably not less than 0.40. Further, if the shortest distance L1 is too great, it is impossible to secure a sufficient opening area in the crown portion 4, and a center of gravity of the head 1 tends to become higher. From this point of view, it is desirable that an upper limit of the ratio (L1/La) is preferably not more than 0.85, more preferably not more than 0.80, and further preferably not more than 0.60.

Figure 2:
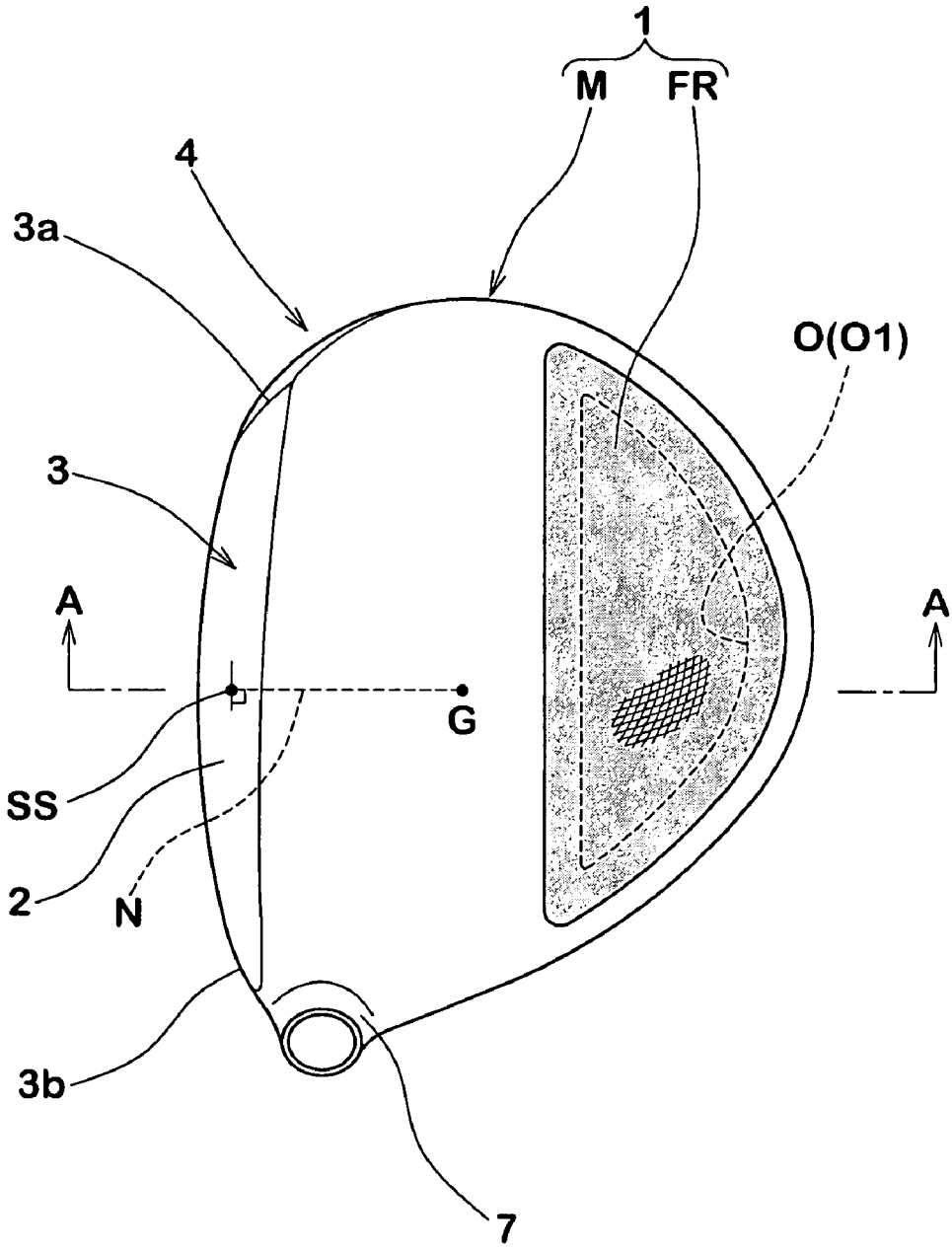
FIG. 2 is a plan view thereof.
Figure 3:
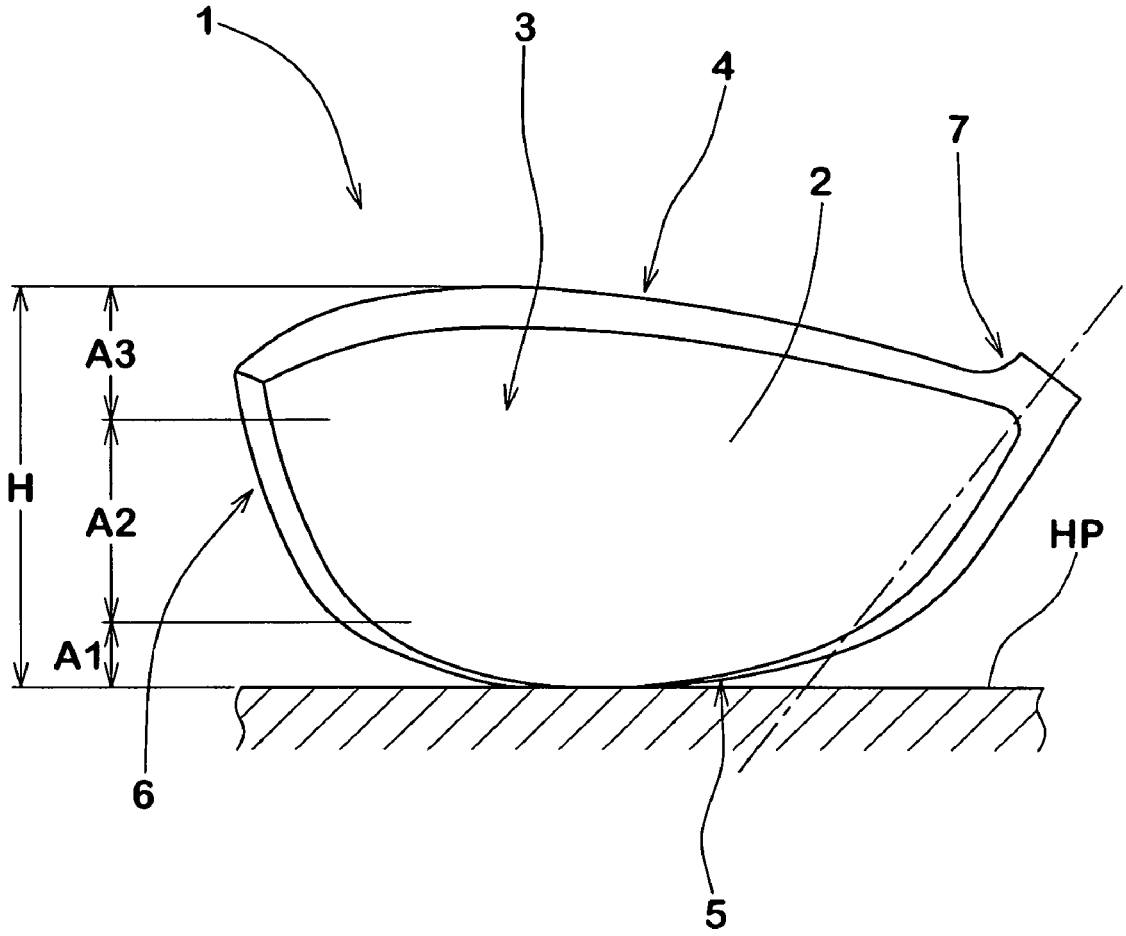
FIG. 3 is a front view of the head.

Here, the front-back direction is a direction which is parallel to a normal line N drawn to the club face 2 from the center of gravity G in a plan view in the standard condition, as illustrated in FIG. 2.

In the same manner, the sole main wall 11 includes a sole body portion 11*a* forming an outer surface of the sole portion 5, and a sole receiving portion 11*b* around the lower opening O2.

The lower opening O2 is provided close to the back face side of the sole portion 5 in the same manner as the upper opening O1. Accordingly, the sole main portion 11 serves for securing a sufficient opening area while securing strength.

The sole receiving portion 11*b* has a stepped face for contacting and supporting the inner surface of the peripheral portion of a lower cover member FR2 to be attached thereto. Further, the sole receiving portion 11*b* is annularly formed around the lower opening O2.

In this case, in the same manner as mentioned above, it is desirable that the ratio (L2/La) between the head length La, and a horizontal shortest distance L2 from the leading edge Le to the lower opening O2 is preferably not less than 0.15, more preferably not less than 0.20, and further preferably not less than 0.30, and it is desirable that an upper limit thereof is preferably not more than 0.70, more preferably not more than 0.60, and further preferably not more than 0.50.

Further, the side main wall 12 includes a side body portion 12*a* forming an outer surface of the side portion 6, and a side receiving portion 12*b* around the middle opening O3 provided on the back face side in the side portion 6.

The side receiving portion 12*b* has a stepped face for contacting and supporting the inner surface of the peripheral portion of a middle cover member FR3 to be attached thereto.

Figure 4:
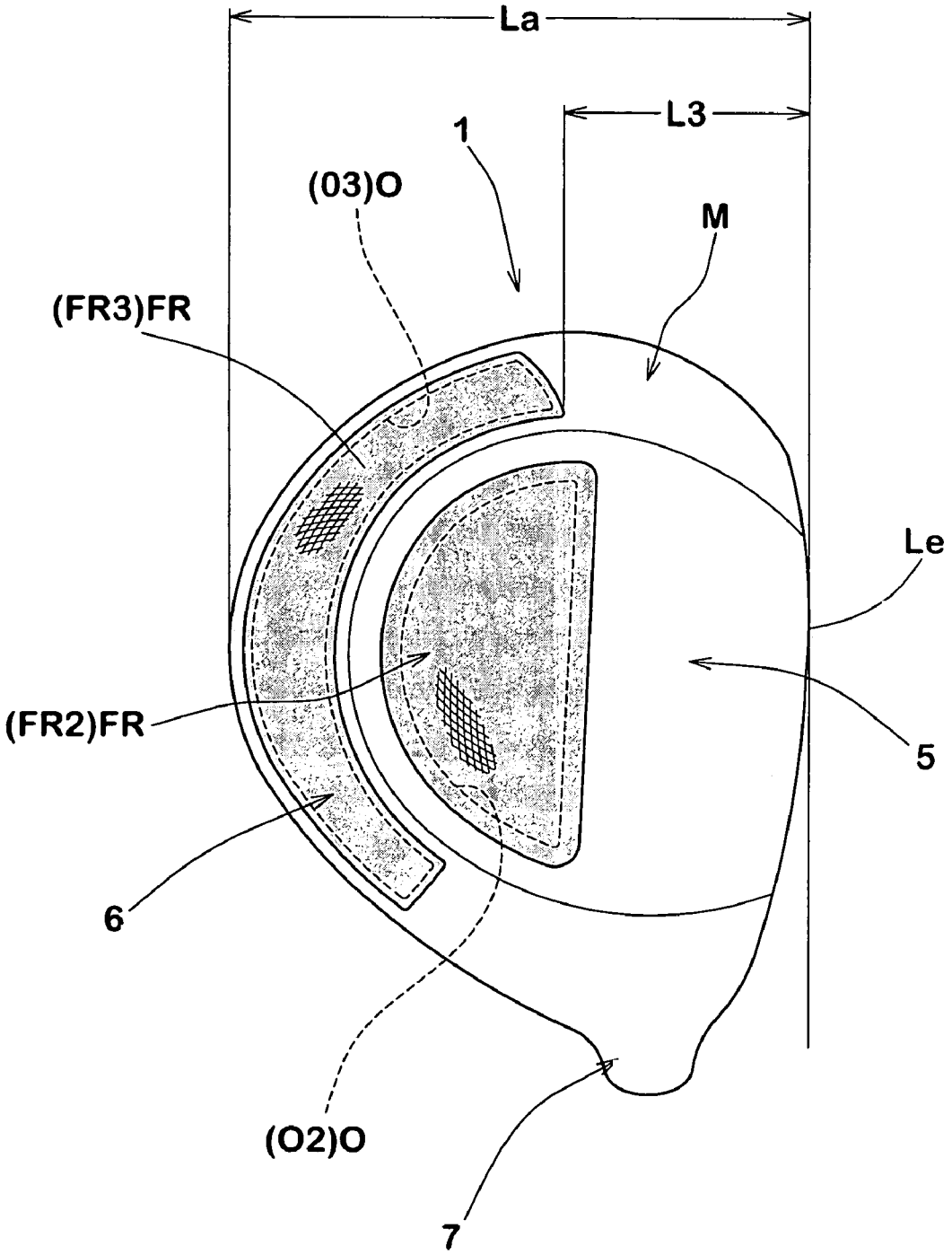
FIG. 4 is a bottom view of the head.

Further, on the basis of the same reason as the crown main wall 11 and the sole main wall 11, it is desirable that the ratio (L3/La) between the head length La, and a shortest distance L3 (as illustrated in FIG. 4) in the front-back direction from the leading edge Le to the middle opening O3 is preferably not less than 0.20, more preferably not less than 0.30, and further preferably not less than 0.50, and it is desirable that an upper limit thereof is preferably not more than 0.80, more preferably not more than 0.70, and further preferably not more than 0.60.

In this case, when each of the ratios (L1/La), (L2/La) and (L3/La) is limited, not only the face portion 3 but also the portion which is positioned at the rear thereof and to which a great impact force is applied at the time of hitting the ball are formed by a metal material, so that it is possible to securely prevent the durability from being lowered.

The upper cover member FR1, the lower cover member FR2 and the middle cover member FR3 are respectively attached to the receiving portions 10*b*, 11*b* and 12*b* so as to cover the openings O1, O2 and O3. The respective cover members FR1, FR2 and FR3 are apart from each other without being in contact with each other, however, may be integrally formed. In the present embodiment, the respective cover members FR1 to FR3 are firmly fixed to the respective receiving portions 10*b*, 11*b* and 12*b* by an adhesive agent. Further, the respective receiving portions 10*b*, 11*b* and 12*b* serve for flush finishing the cover members FR and the head main body M arranged in the respective portions on the basis of the step.

As illustrated in FIG. 5, a width Wa of the each receiving portion 10*b*, 11*b* and 12*b* measured in a perpendicular direction from an edge of the each opening O is not particularly limited, however, if it is too small, the bonding area between the main body M and the cover members FR becomes small, whereby a bonding strength tends to be lowered, and if it is inversely too large, the area of the openings O become small, whereby there is a tendency that the weight saving effect can not be sufficiently obtained. From this point of view, it is desirable that the width Wa is, for example, not less than 5.0 mm, and more preferably not less than 10.0 mm, and it is desirable that the upper limit is not more than 30.0 mm, more preferably not more than 20.0 mm and further preferably not more than 15.0 mm. In this case, the width Wa may be fixed, or may be changed.

Each cover member FR is formed as a thin curved plate and is attached to the main body M without contacting to each other. These cover members FR in this embodiment are molded apart from the main body M, and are adhered to the main body M using the adhesive agent.

At lest one cover member FR is made of a fiber reinforced resin composed of a matrix resin and reinforcing fibers. The fiber reinforced resin has a smaller specific gravity in comparison with the metal material. Accordingly, the club head 1 according to the present embodiment can obtain a comparatively great weight saving effect in the crown portion 4, the sole portion 5 and/or the side portion. The saved weight is consumed for enlarging a size of the main body M or is allocated to a proper portion of the main body M, for example. Accordingly, it serves for improving a freedom of designing a weight allocation of the club head 1. In this embodiment, all the cover members are made of the fiber reinforced resin.

The matrix resin mentioned above is not particularly limited, however, there can be listed up, for example, an epoxy resin, an unsaturated polyester resin, a vinyl ether resin, a phenol resin, a nylon resin and a polycarbonate resin. Further, the fibers are not particularly limited, however, can employ a carbon fiber; a glass fiber; an organic fiber such as an aramid fiber, a polyphenylene benzoxazole resin fiber (PBO fiber) or the like; and a metal fiber such as an amorphous fiber, a titanium fiber or the like. Especially, the carbon fiber having a small specific gravity and a large tensile strength is preferable. Here, the fibers comprise short fibers and/or long fibers.

Further, in order to improve the rigidity and the durability of the cover member FR, it is desired that the elastic modulus of the fiber is not less than 50 GPa, more preferably not less than 100 GPa, and further preferably not less than 200 GPa. Further, it is desirable that an upper limit is preferably not more than 450 GPa, more preferably not more than 350 GPa, and further preferably not more than 300 GPa. In this case, the elastic modulus of the fiber corresponds to an elastic modulus in tension, and is constituted by a value measured according to "carbon fiber test method" in JIS R7601.

In this embodiment, the cover members FR are made of the fiber reinforcing resin which is compounded the epoxy resin and the carbon fibers and has a specific gravity in the range of from 1.3 to 1.4.

Further, in the club head 1 in accordance with the present invention, a resin content of the fiber reinforced resin forming the cover member FR is set in the range of from 25% to 60%. The "resin content" mentioned above is a weight ratio of the resin with respect to a total weight of the fiber reinforced resin. The weight of the resin is obtained by picking up only the fiber by chemically decomposing or removing only the resin from the fiber reinforced resin to be measured, and subtracting the total weight of the fiber from the previously measured weight of the fiber reinforced resin. In order to chemically remove the resin from the fiber reinforced resin, a heated nitric acid solution is, for example, used. Further, in order to chemically remove the resin, for example, from a prepreg, a methyl ethyl ketone is, for example, used. In the case that a plurality of cover members FR are used in the club head 1, it is preferable that an average value of the resin content of the respective cover members FR satisfies the numerical value range mentioned above. However, it is desirable that all the resin contents of the respective cover members FR preferably satisfy the numerical value range mentioned above.

The inventors pay attention to a matrix resin of the fiber reinforced resin. In general, a role of the matrix resin in the fiber reinforced resin is to bind the fibers and hold the shape, and the matrix resin is considered not to substantially take part in the rigidity itself. However, the inventors have found that the matrix resin in the club head 1 has a great influence on an adhesive property to the metal material and the ball hitting feeling.

A mechanism of peel-off between the metal material and the fiber reinforced resin is based on the matter that a micro crack is generated in the surface of the fiber reinforced resin due to a stress in a vertical direction and a shearing direction applied to an adhesive interface of the both members, and the micro crack grows in the adhesive interface. In this case, the inventors have found that crack resistance in the adhesive interface of the fiber reinforced resin is improved by increasing the resin content of the fiber reinforced resin. Accordingly, increasing the rate of the matrix resin in the fiber reinforced resin is conductive to an improvement of the adhesive strength with respect to the metal material.

Next, the matrix resin brings out a vibration absorbing effect of quickly damping a vibration in comparison with the metal material. Accordingly, it is possible to quickly damp the vibration of the club head 1 by the cover member FR so as to obtain an improved ball hitting feeling, by making the resin content of the fiber reinforced resin equal to or more than a fixed value as in the present embodiment.

In order to improve both the crack resistance and the ball hitting feeling, it is desirable that the resin content is preferably not less than 30%, more preferably not less than 35%, and further preferably not less than 40%, but in order to prevent the deterioration of rigidity of the fiber reinforced resin with the reduction of the fiber amount, it is preferable that the resin content is not more than 60%, more preferably not more than 55%, and further preferably not more than 50%.

Further, in an aspect in which a plurality of cover members FR are provided, the respective resin contents may be the same or may be different. It is particularly preferable that the ball hitting feeling is improved by relatively increasing the resin content of the cover member which is less affected by the impact force at the time of hitting the ball, and on the contrary, the resin content is made relatively smaller with respect to the cover member comparatively more affected by the impact force. In particular, it is desirable that the resin content of the upper and lower cover members FR1 and FR2 are smaller than the resin content of the middle cover member FR3.

In order to obtain a greater impact absorbing effect, it is desirable that a surface area so of the opening projected onto the head surface is not less than 15%, more preferably not less than 20%, and further preferably not less than 30% of the entire surface area sh of the head 1. on the other hand, if the surface area so of the opening O is too large, the strength of the main body M tends to be deteriorated. From this point of view, it is desirable that the surface area so of the opening O is preferably not more than 70%, more preferably not more than 60%, and further preferably not more than 50% of the entire surface area sh of the head 1. In this case, the surface area Sh above mentioned is specified by filling in a hole 7*a* for inserting a shaft provided in the neck portion 7. In case that a plurality of openings is provided to the main body M, the above mentioned surface area so means a total area of the surface areas of the openings.

Further, when the opening area of each of the openings O1, O2 and O3 becomes smaller, there is a tendency that the weight saving and the impact absorbing effect can not be sufficiently obtained in the opening, and on the contrary, if it is too large, the durability of the club head 1 tends to be deteriorated. From this point of view, it is desirable that the surface area of each of the openings O1, O2 and O3 is preferably not less than 3%, and more preferably not less than 5% of the entire surface area sh of the club head 1, and it is desirable that the upper limit is preferably not more than 40%, more preferably not more than 35%, and further preferably not more than 30% of the entire surface area sh of the club head 1. In this case, the areas of the openings O1, O2 and O3 can be set within a preferable range in any one combination of the upper limits and the lower limits mentioned above, respectively.

In accordance with a further preferable aspect, it is desirable that the opening O is provided in at least two zones, more preferably three zones of a lower zone A1 which is ⅙ or less of the maximum head height H from the horizontal surface HP, an upper zone A3 which is ⅔ or more of the maximum head height H from the horizontal surface HP, and a middle zone A2 between the lower zone A1 and the upper zone A3, in the standard condition mentioned above, as illustrated in FIG. 3. Accordingly, the opening O is provided in the head main body M with a good balance, and it is possible to obtain a further improvement of the weight saving and the ball hitting feeling.

Further, the cover member FR can be formed by using a so-called internal pressure forming method of integrally forming the cover member FR with the main body M at the time of molding, for example, by attaching at least one uncured prepreg sheet to the receiving portion 10*b*, 11*b* or 12*b* so as to cover the opening O of the main body M and casting this in a mold. In the internal pressure forming method, the prepreg sheet is exposed to heat and pressure from the inner and outer sides by previously arranging a bladder in the hollow portion i of the main body M and inflating the bladder to be formed in a preferable shape.

A description is given above of the embodiment in accordance with the present invention, however, the present invention is not limited to the embodiment mentioned above, and can be applied, for example, to an iron type or utility type golf club head having a hollow structure. Further, it goes without saying that a shape and the like of the opening O are not limited to the illustrated particular shapes, and can be modified variously.

Comparison Test:

Wood type golf club heads (examples and comparative examples) are manufactured by way of trial on the basis of the specification of Table 1, and various tests and measurements were executed. All of the main bodies were made of a titanium alloy (Ti-6Al-4V) cast product. Further, the cover members were formed by using five unidirectional prepreg sheets formed by drawing and aligning a carbon fiber "HR40" (tensile elasticity: 392 GPa) manufactured by Mitsubishi Rayon Co., Ltd., and impregnating this with a matrix resin (bisphenol A epoxy resin). The prepreg sheets were prepared such that a resin content is 20%, 30%, 35%, 40%, 50%, 60% and 70%, as shown in Table 1. Further, in the structure using a plurality of cover members, the respective resin contents were made equal.

Figure 7:
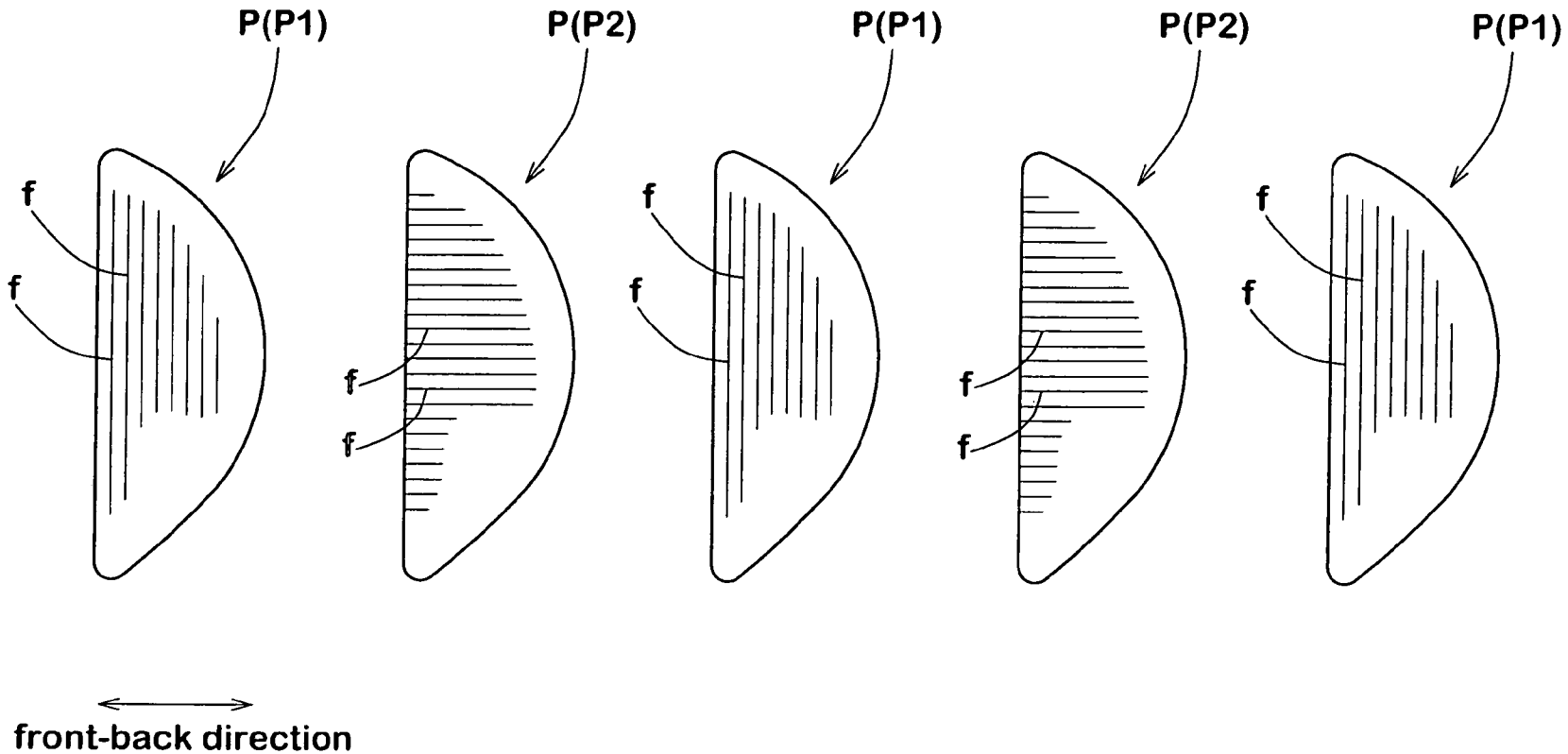
FIG. 7 is an exploded perspective view showing a plurality of plies of prepreg.

Further, as a representative example is illustrated in FIG. 7, the cover member was formed by heating and curing a laminated body obtained by alternately arranging first prepreg sheets P1 with the carbon fibers f orientated at 90 degrees (in a toe heel direction) with respect to the front back direction of the head, and second prepreg sheets P2 with the carbon fibers f orientated at 0 degree with respect to the front back direction so as to overlap at five sheets. Further, the cover member was integrally bonded to the main body by using an adhesive agent (EW2214 manufactured by Sumitomo 3M Co. Ltd.).

Each of the heads aimed at a head volume of 400 $cm^3$, a real loft angle of 11 degrees and a lie angle of 57 degrees. Further, a thickness of the cover member is substantially set to 0.8 mm. A description will be given below of only features of comparative Examples and Examples briefly.

COMPARATIVE EXAMPLES 1 and 2

The resin contents of the fiber reinforced resin of the cover member were respectively 70% and 15%.

COMPARATIVE EXAMPLES 3

The club head was entirely formed by a titanium alloy, and had no opening and no cover member.

EXAMPLE 11

Figure 8:
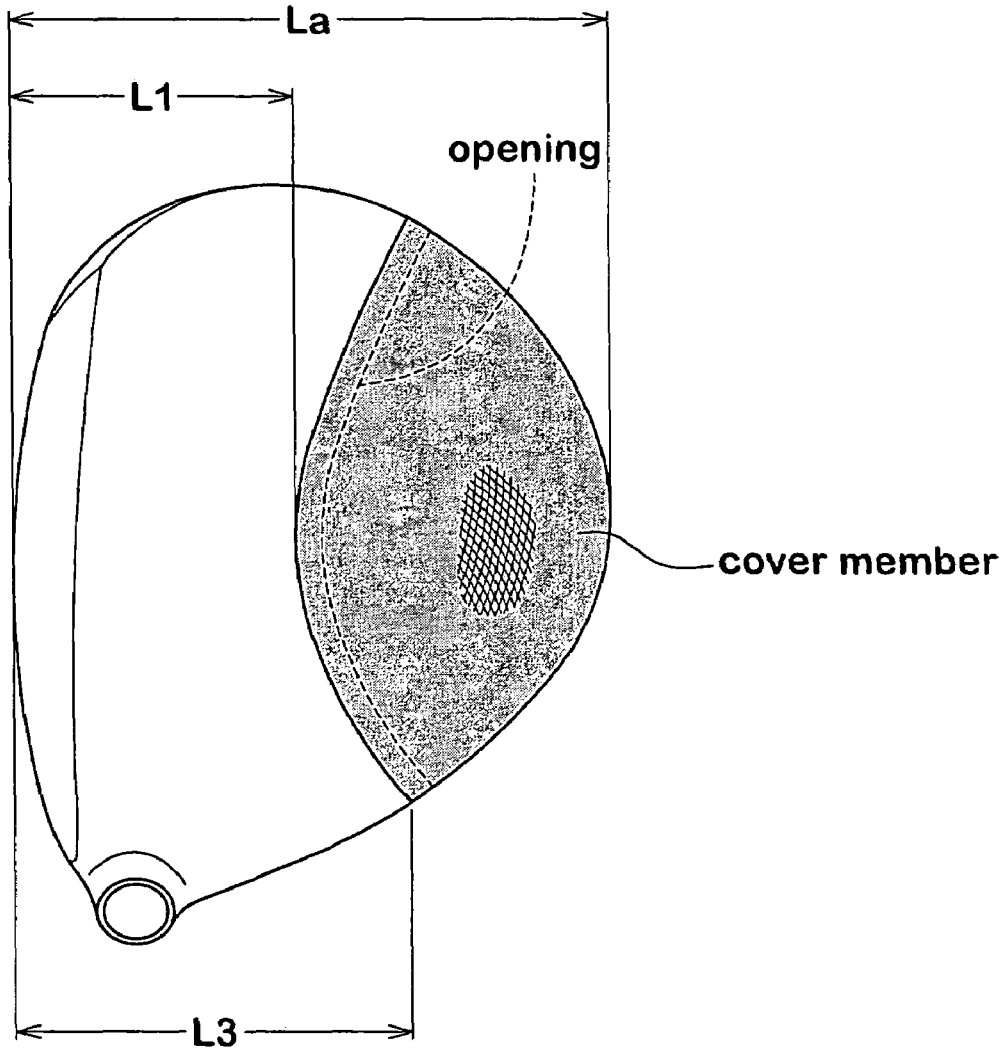
FIG. 8 is a plan view showing another embodiment of the present invention.
Figure 9:
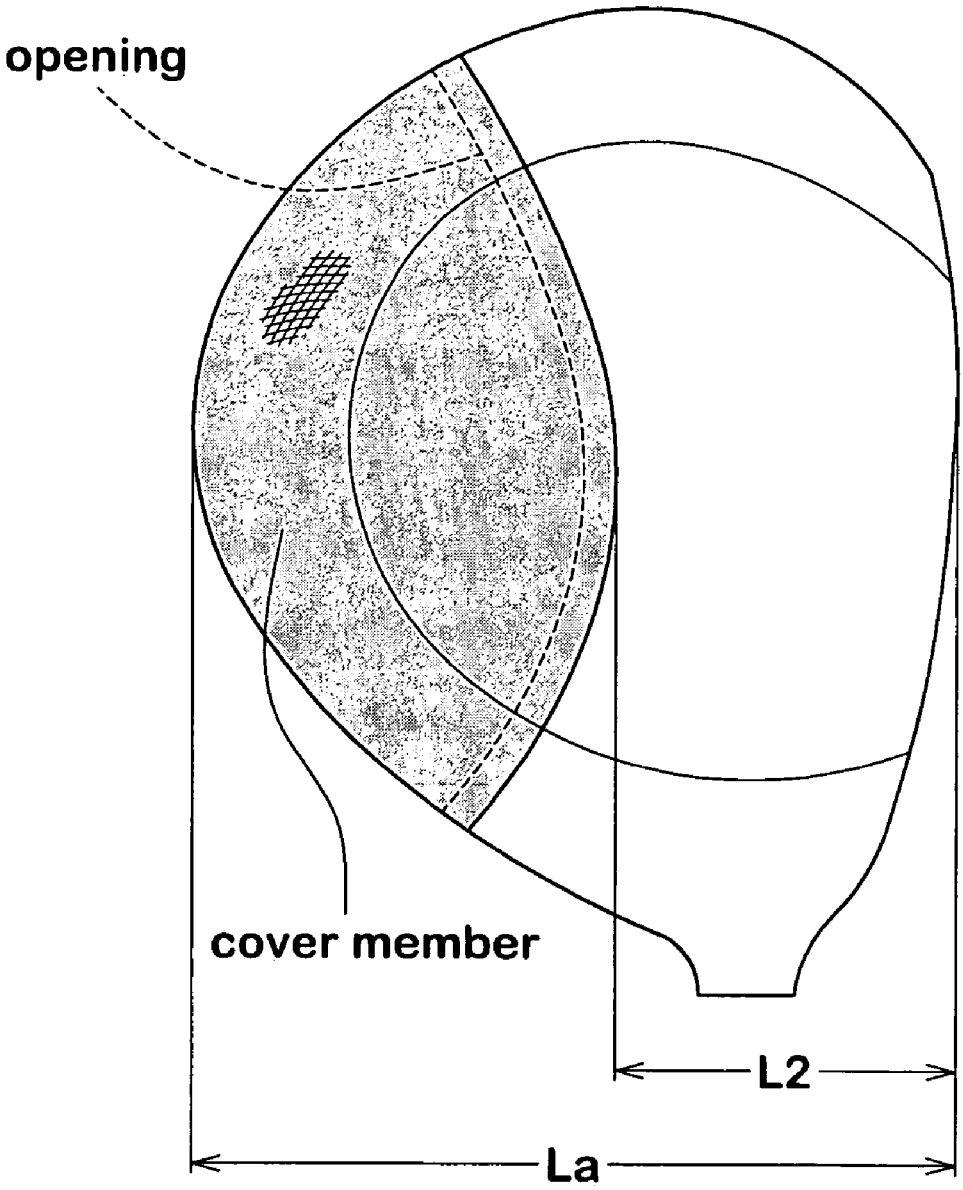
FIG. 9 is a bottom view thereof.

As illustrated in FIGS. 8 and 9, the opening and the cover member were respectively constituted by one element.

EXAMPLE 12

The main body having no opening in the lower zone is structured by adjusting the number of the opening in the head main body.

EXAMPLE 13

The head main body having no opening in the middle zone is structured by adjusting the number of the opening in the head main body.

COMPARATIVE EXAMPLE 4

The head main body having no opening in the middle zone and the lower zone is structured by adjusting the number of the opening in the head main body.

OTHER EXAMPLES

The head main body having the opening in the lower zone, the middle zone and the upper zone is structured by adjusting the position of the opening in the main body.

Further, a method of evaluation is as follows.

Durability

A 45 inch wood type golf clubs were manufactured by attaching the same shaft (MP200, Flex R manufactured by SRI Sports Co. Ltd.) made of fiber reinforced resin to each of the trial heads, each of the clubs was attached to a swing robot, and four thousand of 2-piece golf balls were hit by a sweet spot SS (as illustrated in FIG. 2) of a club face in each of the clubs at a head speed of 50 m/s. An evaluation is executed on the basis of the ball number at which the head is broken.

Ball Hitting Feeling

The ball hitting feeling was compared between each of the trial clubs mentioned above, and a comparative club having a head (Comparative Example 3) entirely made of the titanium alloy. A tester was constituted by ten right-handed golfers (having handicaps in the range of from 5 to 15), and the number of persons feeling that the impact at the time of hitting the ball was smaller and the ball hitting feeling was better than Comparative Example 3 is recorded. The larger the numerical value is, the better the performance is.

Moment of Inertia

In the standard condition of the club head, a moment of inertia around a vertical axis passing through a center of gravity of the club head (a horizontal moment of inertia), and a moment of inertia around a horizontal axis in a toe and heel direction passing through the center of gravity and perpendicular to the front back direction (a vertical moment of inertia) are measured by using MODEL NO. 005-002 of MOMENT OF INERTIA MEASURING INSTRUMENT manufactured by INERTIA DYNAMICS Inc. The larger the numerical value is, the smaller the displacement of the head at the time of a miss shot is, so that a good structure is obtained.

Results of tests are shown in Table 1.

TABLE 1-1

| | | Comparative Example 1 | Comparative Example 2 | Comparative Example 3 | Example 1 | Example 2 | Example 3 | Example 4 | Example 5 | Example 6 |
|---|---|---|---|---|---|---|---|---|---|---|
| Entire surface area of Head Sh [$cm^2$] | | | | | | 280 | | | | |
| Total surface area of openings Sa/Sh [%] | | | 30 | 30 | 0 | 15 | 30 | 50 | 60 | 70 |
| Opening area included in upper zone/Sh [%] | | 15 | 15 | — | 5 | 15 | 30 | 30 | 30 | 15 |
| Opening area included in middle zone/Sh [%] | | 5 | 5 | — | 5 | 5 | 5 | 5 | 15 | 5 |
| Opening area included in lower zone/Sh [%] | | 10 | 10 | — | 5 | 10 | 15 | 25 | 25 | 10 |
| Number of opening(s) | | 3 | 3 | 0 | 3 | 3 | 3 | 3 | 3 | 3 |
| Number of cover member(s) | | 3 | 3 | 0 | 3 | 3 | 3 | 3 | 3 | 3 |
| Resin content of fiber reinforced resin [%] | | 70 | 15 | — | 40 | 40 | 40 | 40 | 40 | 25 |
| Ratio (L1/La) | | 0.6 | 0.6 | — | 0.8 | 0.6 | 0.2 | 0.2 | 0.2 | 0.6 |
| Ratio (L2/La) | | 0.4 | 0.4 | — | 0.5 | 0.4 | 0.3 | 0.2 | 0.2 | 0.5 |
| Ratio (L3/La) | | 0.6 | 0.6 | — | 0.6 | 0.6 | 0.6 | 0.6 | 0.8 | 0.6 |
| Test result | Durability [ball number] | 2900 | 4000 | 4000 | 4000 | 4000 | 4000 | 3800 | 2900 | 4000 |
| | Ball hitting feeling [*] | 10 | 2 | — | 5 | 10 | 10 | 10 | 10 | 4 |
| | Horizontal moment of inertia [$g \cdot cm^2$] | 3800 | 3750 | 3400 | 3650 | 3800 | 3950 | 4050 | 4200 | 3800 |
| | Vertical moment of inertia [$g \cdot cm^2$] | 2300 | 2250 | 2000 | 2100 | 2300 | 2400 | 2500 | 2700 | 2300 |

[*] Number of persons feeling that the ball hitting feeling is better

TABLE 1-2

| | | Example 7 | Example 8 | Example 9 | Example 10 | Example 11 | Example 12 | Example 13 | Comparative Example 4 | Comparative Example 5 |
|---|---|---|---|---|---|---|---|---|---|---|
| Head total surface area Sh [$cm^2$] | | | | | | 280 | | | | |
| Total opening area of opening Sa/Sh [%] | | 30 | 30 | 30 | 30 | 30 | 30 | 50 | 5 | 10 |
| Opening area included in upper zone/Sh [%] | | 15 | 15 | 15 | 15 | 10 | 20 | 30 | 5 | 5 |
| Opening area included in middle zone/Sh [%] | | 5 | 5 | 5 | 5 | 10 | 10 | 0 | 0 | 2.5 |
| Opening area included in lower zone/Sh [%] | | 10 | 10 | 10 | 10 | 10 | 0 | 20 | 0 | 2.5 |
| Number of opening(s) | | 3 | 3 | 3 | 3 | 1 | 2 | 2 | 1 | 3 |
| Number of cover member(s) | | 3 | 3 | 3 | 3 | 1 | 2 | 2 | 1 | 3 |
| Resin content of fiber reinforced resin [%] | | 30 | 35 | 50 | 60 | 40 | 40 | 40 | 40 | 40 |
| Ratio (L1/La) | | 0.6 | 0.6 | 0.6 | 0.6 | 0.5 | 0.4 | 0.2 | 0.8 | 0.8 |
| Ratio (L2/La) | | 0.4 | 0.4 | 0.4 | 0.4 | 0.5 | — | 0.2 | — | 0.3 |
| Ratio (L3/La) | | 0.6 | 0.6 | 0.6 | 0.6 | 0.7 | 0.5 | — | — | 0.7 |
| Test result | Durability [ball number] | 4000 | 4000 | 4000 | 4000 | 3400 | 3700 | 4000 | 4000 | 4000 |
| | Ball hitting feeling [*] | 7 | 9 | 10 | 10 | 9 | 10 | 10 | 0 | 0 |
| | Horizontal moment of inertia [$g \cdot cm^2$] | 3800 | 3800 | 3800 | 3800 | 3800 | 3800 | 3950 | 3500 | 3550 |
| | Vertical moment of inertia [$g \cdot cm^2$] | 2300 | 2300 | 2300 | 2300 | 2300 | 2300 | 2400 | 2000 | 2050 |

[*] Number of persons feeling that the ball hitting feeling is better

As a result of tests, the examples are improved in the durability and the ball hitting sound, and it is possible to make certain of a significant effect of the present invention. Further, it is possible to make certain of a matter that the moment of inertia is large, and degree of freedom in a weight allocation design is high.

The invention claimed is:

1. A hollow golf club head comprising a main body made of at least one kind of metal material, said main body provided with a plurality of openings, a total surface area of the openings projected onto the head surface being from 15% to 70% of the entire surface area of the head, and a plurality of cover members provided apart from each other respectively and attached to said main body using an adhesive agent so as to cover said openings, said cover members made of a fiber reinforced resin, and the plurality of cover members comprising at least two kinds of cover members having different percentage resin contents.

2. The golf club head according to claim 1, wherein the golf club head has a volume in the range of from 300 $cm^3$ to 500 $cm^3$.

3. The golf club head according to claim 1, wherein in a standard condition in which the golf club head is grounded on a horizontal surface at a prescribed lie and loft angles thereof, said openings are provided in at least two zones of a lower zone which is ⅙ or less of a maximum head height from the horizontal surface, an upper zone which is ⅔ or more of the maximum head height from the horizontal surface, and a middle zone which is a zone between the lower zone and the upper zone.

4. The golf club head according to claim 1, wherein the fiber reinforced resin has a resin content in the range of from 30% to 60%.

5. The golf club head according to claim 1, wherein the fiber reinforced resin has a resin content in the range of from 35% to 60%.

6. The golf club head according to claim 1, wherein said main body is provided with at least three openings covered with at least three cover members.

7. The golf club head according to claims 1, wherein the head comprises:

a face portion whose front face defines a club face for striking a ball;

a crown portion intersecting the club face at the upper edge thereof;

a sole portion intersecting the club face at the lower edge thereof; and a side portion between the crown portion and the sole portion which extends from a toe-side edge to a heel-side edge of the club face through the back face of the club head; wherein said main body is provided with an upper opening in the crown portion, a lower opening in the sole portion and a middle opening in the side portion.

8. The golf club head according to claim 7, wherein said each opening has the surface area in the range of from 3% to 40% of the entire surface area of the head.

9. The golf club head according to claim 1, wherein the openings comprise an upper opening provided on a crown portion of the head, the cover members comprise an upper cover member covering the upper opening, a crown receiving portion is provided around the upper opening, and the crown receiving portion has a stepped face for contacting and supporting an inner surface of a peripheral portion of the upper cover member.

10. The golf club head according to claim 1, wherein the fiber of the cover member has an elastic modulus in tension of from 50 to 450 GPa.

11. The golf club head according to claim 1, wherein the cover members are made using a unidirectional prepreg sheet, and the unidirectional prepreg sheet has fibers aligned at a certain orientation dipped in the resin.

12. The golf club head according to claim 11, wherein the cover members are made using a plurality of unidirectional prepreg sheets lapped on each other, and the prepreg sheets comprise at least one first prepreg sheet having fibers oriented at 90 degrees with respect to a front-back direction of the head and at least one second prepreg sheet having fibers oriented at 0 degree with respect to the front-back direction of the head.

13. The golf club head according to claim 1, wherein the openings comprise an upper opening provided on a crown portion of the head, the cover members comprise an upper cover member covering the upper opening, and the ratio (L1/La) between a head length La corresponding to a maximum length in a front-back direction of the head and a horizontal shortest distance L1 in the front-back direction from the leading edge Le to the upper opening is not less than 0.40.

14. The golf club head according to claim 1, wherein the openings comprise a lower opening provided on a sole portion of the head, the cover members comprise a lower cover member covering the lower opening, and the ratio (L2/La) between a head length La corresponding to a maximum length in a front-back direction of the head and a horizontal shortest distance L2 from the leading edge Le to the lower opening is not less than 0.30.

15. The golf club head according to claim 1, wherein the cover members comprise an upper cover member covering an upper opening provided on a crown portion of the head, a lower cover member covering a lower opening provided on a sole portion of the head and a middle cover member covering a middle opening provided on a side portion of the head, and the upper and the lower cover members each have the resin content smaller than that of the middle cover member.

16. The golf club head according to claim 1, wherein the fiber reinforced resin has a resin content in the range of from 25% to 60%.

17. A hollow golf club head comprising a main body made of at least one kind of metal material, said main body provided with an opening, a surface area of the opening projected onto the head surface being from 15% to 70% of the entire surface area of the head, and a cover member attached to said main body using an adhesive agent so as to cover said opening, said cover member made of a fiber reinforced resin having a resin content in the range of from 25% to 60%, wherein the opening comprises an upper opening provided on a crown portion of the head, the cover member comprises an upper cover member covering the upper opening without a gap in the coverage of the upper opening provided by the upper cover member, a crown receiving portion is provided around the upper opening, and the crown receiving portion has a stepped face for contacting and providing uninterrupted support for an inner surface of a peripheral portion of the upper cover member.

18. A hollow golf club head comprising a main body made of at least one kind of metal material, said main body provided with an opening, a surface area of the opening projected onto the head surface being from 15% to 70% of the entire surface area of the head, and a cover member attached to said main body using an adhesive agent so as to cover said opening, said cover member made of a fiber reinforced resin having a resin content in the range of from 25% to 60%, wherein the opening comprises an upper opening provided on a crown portion of the head, the cover member comprises an upper cover member covering the upper opening, and the ratio (L1/La) between a head length La corresponding to a maximum length in a front-back direction of the head and a horizontal shortest distance L1 in the front-back direction from the leading edge Le to the upper opening is not less than 0.40.

19. A hollow golf club head comprising a main body made of at least one kind of metal material, said main body provided with an opening, a surface area of the opening projected onto the head surface being from 15% to 70% of the entire surface area of the head, and a cover member attached to said main body using an adhesive agent so as to cover said opening, said cover member made of a fiber reinforced resin having a resin content in the range of from 25% to 60%, wherein the opening comprises a lower opening provided on a sole portion of the head, the cover member comprises a lower cover member covering the lower opening, and the ratio (L2/La) between a head length La corresponding to a maximum length in a front-back direction of the head and a horizontal shortest distance L2 from the leading edge Le to the lower opening is not less than 0.30.

* * * * *